US005235743A

United States Patent [19]

Endo et al.

[11] Patent Number: 5,235,743

[45] Date of Patent: Aug. 17, 1993

[54] METHOD OF MANUFACTURING A PAIR OF TERMINALS HAVING A LOW FRICTION MATERIAL ON A MATING SURFACE TO FACILITATE CONNECTION OF THE TERMINALS

[75] Inventors: Takayoshi Endo; Tamio Watanabe; Kazuaki Sakurai, all of Shizuoka, Japan

[73] Assignee: Yazaki Corporation, Tokyo, Japan

[21] Appl. No.: 921,436

[22] Filed: Jul. 31, 1992

Related U.S. Application Data

[63] Continuation-in-part of Ser. No. 725,112, Jul. 3, 1991, abandoned.

[30] Foreign Application Priority Data

Jul. 11, 1990 [JP] Japan ..... 2-181493
Dec. 18, 1990 [JP] Japan ..... 2-411289

[51] Int. Cl.[5] ..... H01R 43/00

[52] U.S. Cl. ..... 29/685; 29/674; 29/677; 439/886

[58] Field of Search ..... 29/883, 884, 885, 874, 29/876; 439/886

[56] References Cited

U.S. PATENT DOCUMENTS 1,936,469 11/1933 Hill ..... 439/887
3,058,091 10/1962 Henschen ..... 29/874 X
3,975,079 8/1976 Blakesley et al. ..... 439/887
4,031,614 6/1977 Gipe ..... 29/879
4,260,212 4/1981 Ritchie et al. ..... 29/885 X
5,028,492 7/1991 Guenin ..... 439/886

FOREIGN PATENT DOCUMENTS 5983 12/1979 European Pat. Off. .
63-35274 3/1988 Japan .
1571602 7/1980 United Kingdom ..... 29/874

*Primary Examiner*—Carl J. Arbes
*Attorney, Agent, or Firm*—Sughrue, Mion, Zinn, Macpeak & Seas

[57] ABSTRACT

In a pair of male and female connectors, which male connector includes flat plate-like electric contact portion and which female connector includes a tubular body, an electric contact part bent at an obtuse angle, projecting from the tubular body such that the part is located inside of the tubular body, and an electric contact projection provided on said tubular body such that the projection is opposed to a top of the electric contact part, the electric contact portion, the electric contact part and the electric contact projection are coated with a mixture of Teflon and a powder of tin, nickel or the like for the purpose of reducing an insertion force of the male connector into the female connector.

13 Claims, 8 Drawing Sheets

METHOD OF MANUFACTURING A PAIR OF TERMINALS HAVING A LOW FRICTION MATERIAL ON A MATING SURFACE TO FACILITATE CONNECTION OF THE TERMINALS

This is a Continuation-of-Part of application Ser. No. 07/725,112, filed Jul 3, 1991, now abandoned.

BACKGROUND OF THE INVENTION

The present invention relates to a method of manufacturing a pair of terminals, one of which can be inserted into the other by a reduced force so as to be connected to the latter.

FIG. 8 shows a conventional pair of a male and a female terminals 21 and 14 which can be connected to each other by inserting the male terminal 21 into the female one 14. The female terminal 14 is manufactured by punching and bending an electroconductive metal plate not shown in FIG. 8, and has an electric wire connecting portion 15 and a male terminal connecting portion 16. The male terminal connecting portion 16 includes a tubular body 17 having a quadrangular cross section, and an electric contact part 18 which is an elastic part bent at an obtuse angle and continuous to the tubular body 17 and is located inside the tubular body 17. The tubular body 17 has an electric contact projection 20 opposed to the top 19 of the electric contact part 18. The electric contact portion 22 of the male terminal 21, which is a flat plate-like portion, is inserted into the tubular body 17 of the female terminal 14 between the electric contact part 18 and the electric contact projection 20 thereof so that the terminals are connected to each other. The front part of the electric contact portion 22 of the male terminal 21 has slopes 23 for facilitating the insertion of the terminal into the female one 14. The male terminal 21 has an electric wire connecting portion which is the rear portion of the terminal. The male and female terminals 21 and 14 are plated with tin, nickel or the like so that the terminals are prevented from rusting. The terminals 21 and 14 are provided in the housings of a male and a female connectors not shown in FIG. 8, so that the terminals are connected to each other when the connectors are coupled to each other. Since the number of the terminals of each of connectors has recently become large, a force necessary to insert all the male terminals 21 into all the female terminals 14 or couple the connectors to each other, especially a force necessary for the initial stage of the insertion, has become so high that the force exceeds a human engineering limit of about 10 Kg for a work man and it is harder for him to couple the connectors to each other. This is a problem.

SUMMARY OF THE INVENTION

The present invention was made in order to solve the above-mentioned problem.

Accordingly, it is an object of the present invention to provide a pair of terminals, one of which can be inserted into the other by a reduced force so as to be connected to the latter to easily couple multi-terminal connectors to each other. The electric contact portions of the terminals are coated with an electroconductive low-friction material, or only tip parts of the electric contact portions are coated with a low-friction material. For that reason, the force necessary to insert one of the terminals into the other is reduced to facilitate the coupling of the connectors having terminals. In the case that the electric contact portions of the terminals are coated with the electroconductive low-friction material, the layers of the material on the portions are put in contact with each other as one of terminals is inserted into the other. In the case that only the tip parts of the electric contact portions of the terminals are coated with the low-friction material which may not be electroconductive, the portions are put in contact with each other as one of the terminals is inserted into the other. In each of the cases, the magnitude of the force for the initial stage of the insertion is lowered and the terminals are securely electrically connected to each other. As a result, the multi-terminal connectors can be easily and efficiently coupled to each other by hands of a person to diminish the work load on him, or the number of the terminals of each of the connectors can be increased to heighten the capacity of the connectors.

The terminals can be manufactured by either (1) applying the low friction material to and baking it on a metal plate prior to stamping the metal plate; or, (2) applying the low friction material to and baking it on interconnected metal terminals after the stamping process.

According to another aspect of the invention, a method is provided for manufacturing male and female terminals for use in high current applications such as for electrically driven automobiles. The method includes the steps of providing a male terminal having a first cable connecting portion and a first electrical connecting portion; applying a low friction material to an end portion of said first electrical connection portion and baking said low friction coating thereon; providing a female terminal having a second cable connection portion and a second electrical contact portion having a tubular shape; and forming a plurality of longitudinal slits in said second electrical contact portion so as to allow elastic outward expansion thereof for receiving said first electrical contact portion of said male terminal.

DETAILED DESCRIPTION OF THE PREFERRED EMBODIMENTS

Embodiments of the present invention are hereafter described in detail with reference to the drawings attached hereto.

Figure 1:
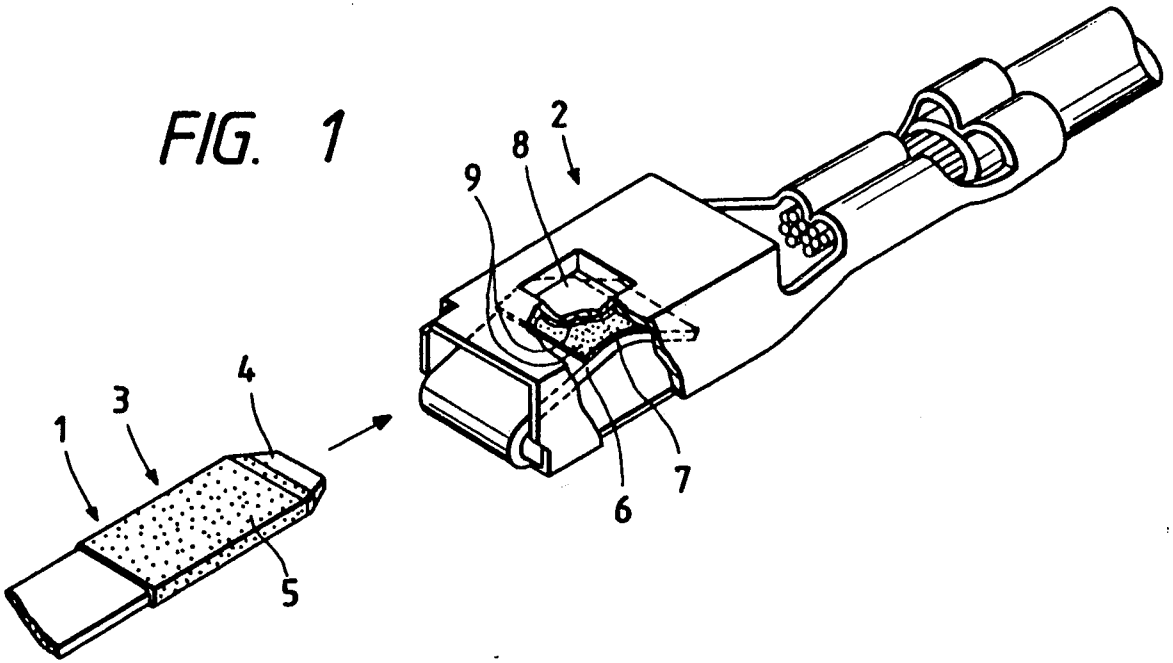
FIG. 1 is a perspective view of a pair of a male and a female terminals which are an embodiment of the present invention.
Figure 2:
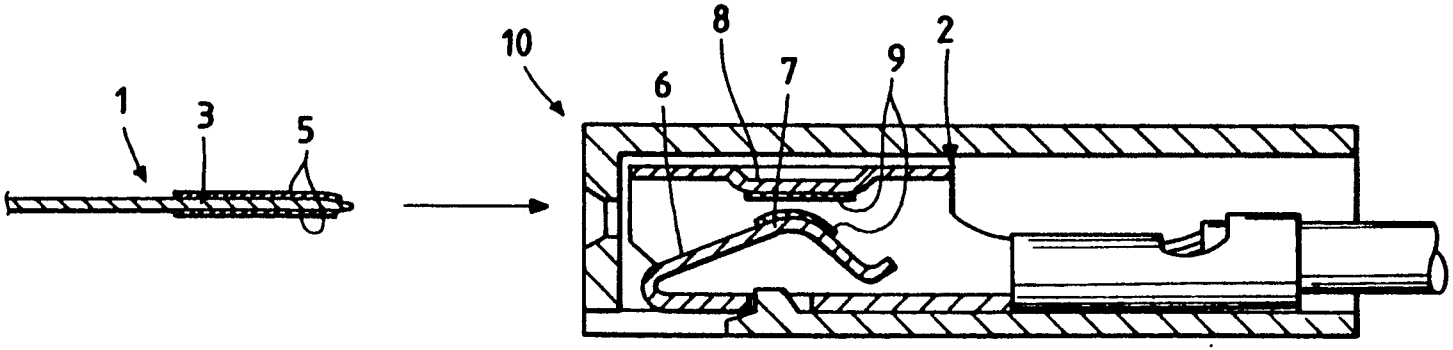
FIG. 2 is a longitudinally sectional view of the terminals in the state that they are put in the housings of connectors.
Figure 3:
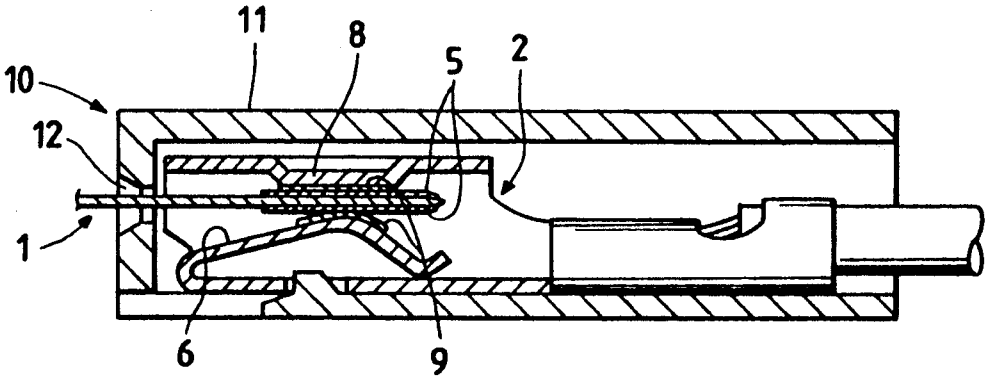
FIG. 3 is a longitudinally sectional view of the terminals in the state that they are coupled to each other.
Figure 8:
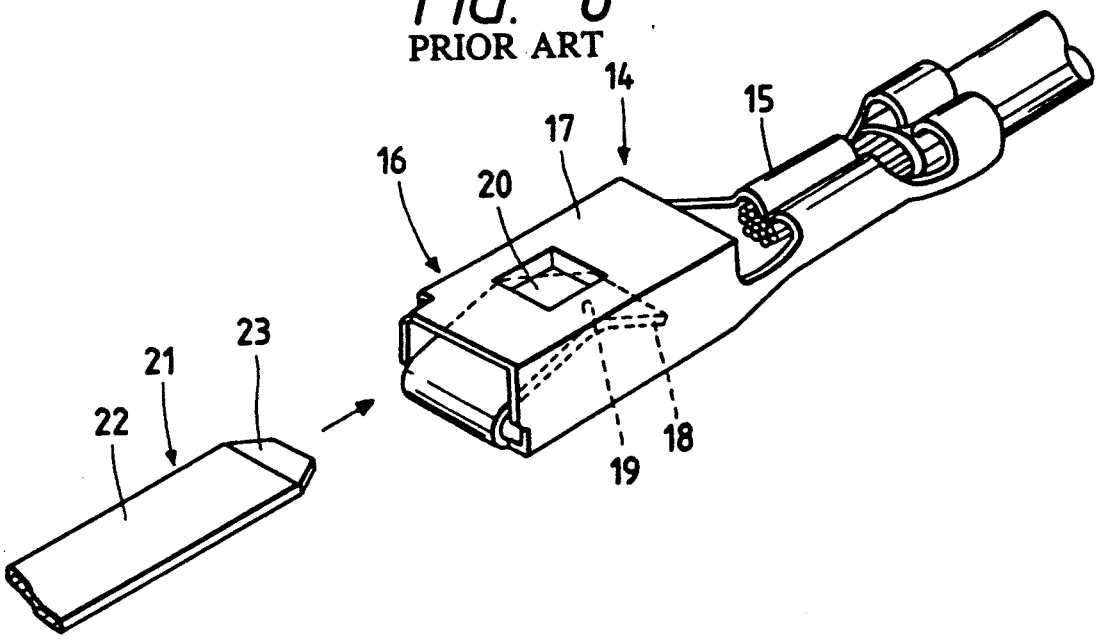
FIG. 8 PRIOR ART
FIG. 8 is a perspective view of the conventional terminals.
Figure 9A:
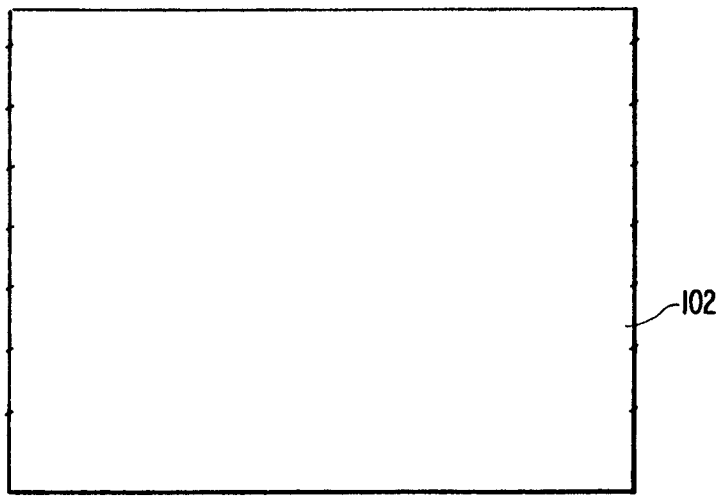
FIGS. 9(*a*)–9(*d*) are plan views illustrating a method of manufacturing a low-friction terminal.
Figure 9B:
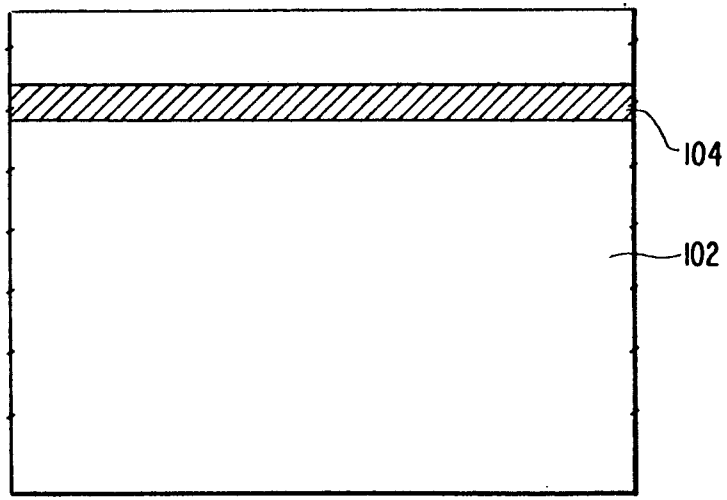
Figure 9C:
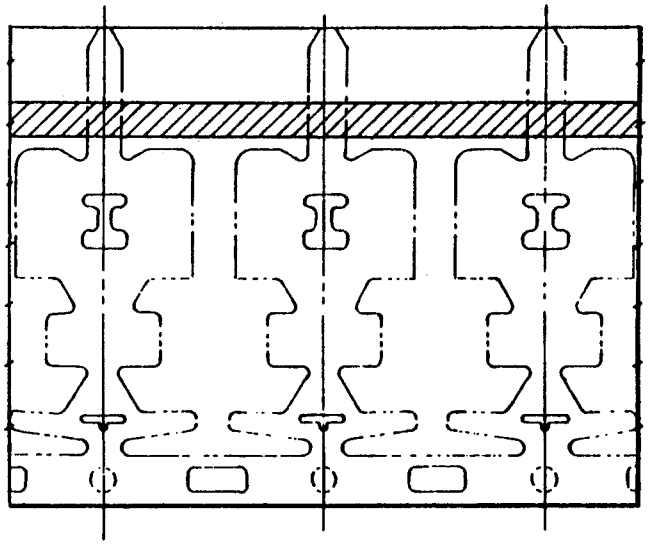
Figure 9D:
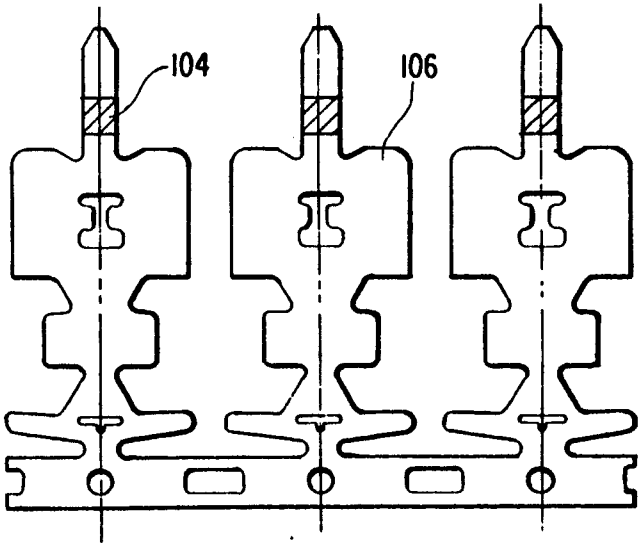
Figure 10C:
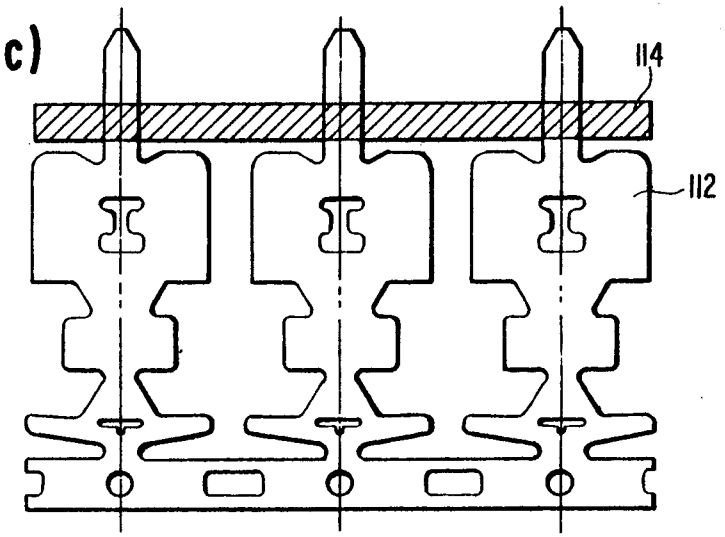
FIGS. 10(*a*)-10(*d*) are plan views illustrating an alternative method of manufacturing a low-friction terminal.
Figure 10D:
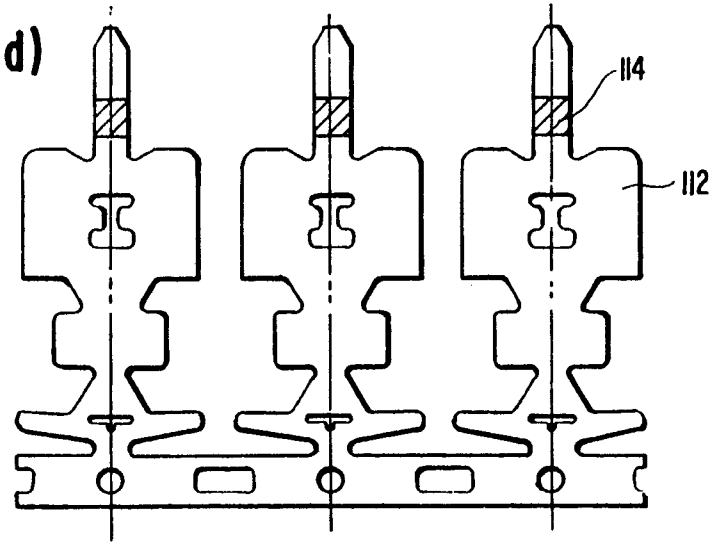
Figure 10A:
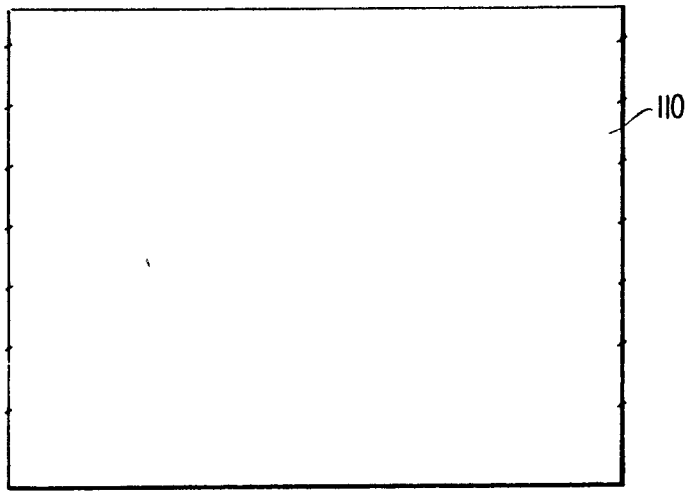
Figure 10B:
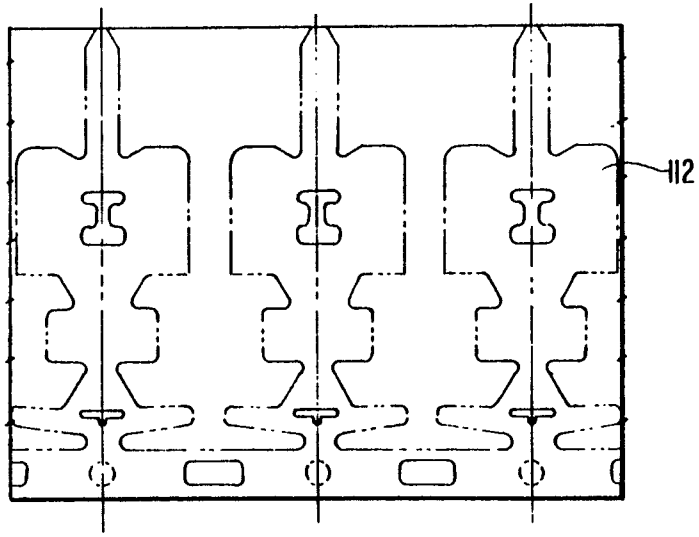

FIGS. 1, 2 and 3 show a pair of a male terminal 1 and a female terminal 2 according to an embodiment of the present invention. The male terminal 1 can be inserted into the female terminal 2 by a reduced force so as to be connected to the latter. The male and the female terminals 1 and 2 are formed similarly to the conventional pair of male and female terminals 21 and 14 shown in FIG. 8. The obverse and reverse sides of the electric contact portion 3 of the male terminal 1 are coated with an electroconductive low-friction material 5 so that the layer of the material extends from the front slopes 4 of the portion to the intermediate portion of the terminal. The electric contact portion 3 is a flat plate-like portion. A mixture of Teflon (polytetrafluoroethylene) and a powder of tin, nickel or the like, which is pulverized very finely to a grain diameter of about 2 to 3 $\mu$, is preferable as the electroconductive low-friction material 5.

In an example of a method of manufacturing the male terminal 1, the mixture of the Teflon and the powder is sprayed onto the part of an electroconductive metal plate, which corresponds to the electric contact portion 3 of the terminal, so that a layer of about 2 to 4 $\mu$ in thickness is made of the mixture on the part. The layer is then baked so that it is secured to the part. The male terminal 1 is thereafter formed of the metal plate by press work similarly to the conventional male terminal 21. The female terminal 2 can be manufactured in the same method.

The top 7 of the electric contact part 6 of the female terminal 2, the vicinity of the top and the electric contact projection 8 of the terminal, which is opposed to the electric contact part 6, are also coated with an electroconductive low-friction material 9 which is the same as the former 5. The electric contact part 6 is an elastic part.

The male and the female terminals 1 and 2 are plated with tin, nickel or the like except or not except at the layers of the low-friction materials 5 and 9.

When a connector including the male terminal 1 and not shown in the drawings and a connector housing 10 including the female terminal 2 are to be coupled to each other, the male terminal is inserted into the female terminal between the electric contact part 6 and electric contact projection 8 thereof through the front opening 12 of the housing 11 of the latter connector, as shown in FIG. 3, so that the terminals are electrically connected to each other. At that time, the low-friction materials 5 and 9 on the male and the female terminals 1 and 2 are put into contact with each other. Since the materials 5 and 9 are made of the Teflon, the coefficient $\mu$ of friction therebetween is about one-fifth of that of friction between conventional tin-plated terminals or is about 0.1. Since a force F necessary to couple all the terminals of the connectors or couple the connectors to each other is expressed as $F=\mu\times W\times N$ where W denotes the contact load on each pair of the male and the female terminals 1 and 2 and N denotes the number of the terminals of each of the connectors, the force is calculated to be about one-fifth of that necessary to couple all the conventional terminals of conventional connectors to each other or couple the conventional connectors to each other.

Even if only one of the male and the female terminals 1 and 2 is coated with the low-friction material 5 or 9, an enough effect is produced as well as the embodiment described above.

Figure 4:
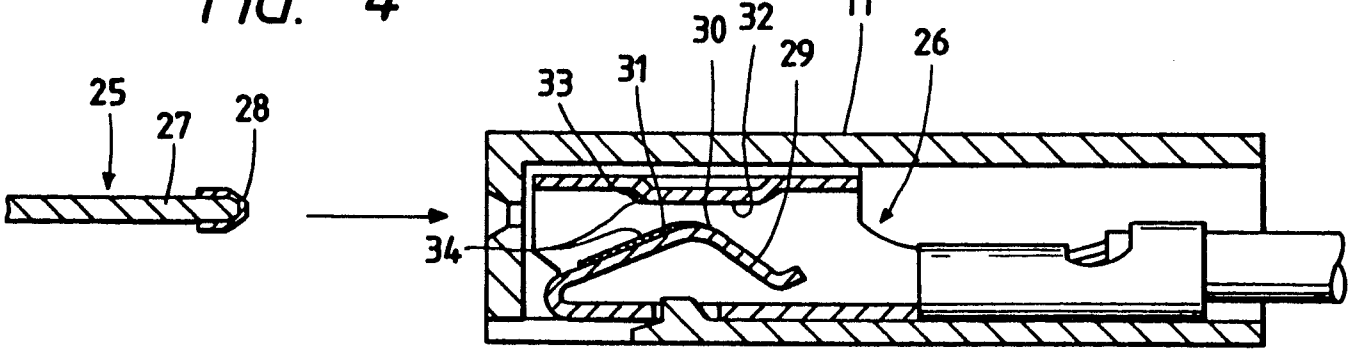
FIG. 4 is a longitudinally sectional view of a pair of a male and a female terminals which are another embodiment of the present invention.
Figure 5:
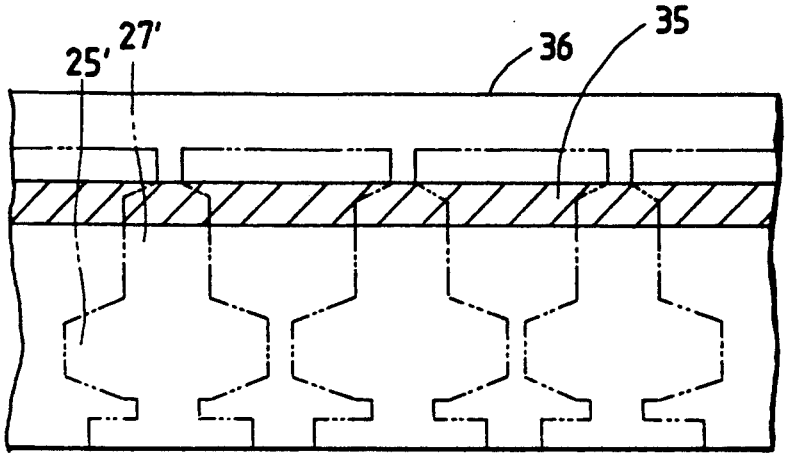
FIG. 5 is a plan view of a terminal material plate to illustrate an example of a procedure to applying a low-friction material to the male terminal part of the plate.
Figure 6:
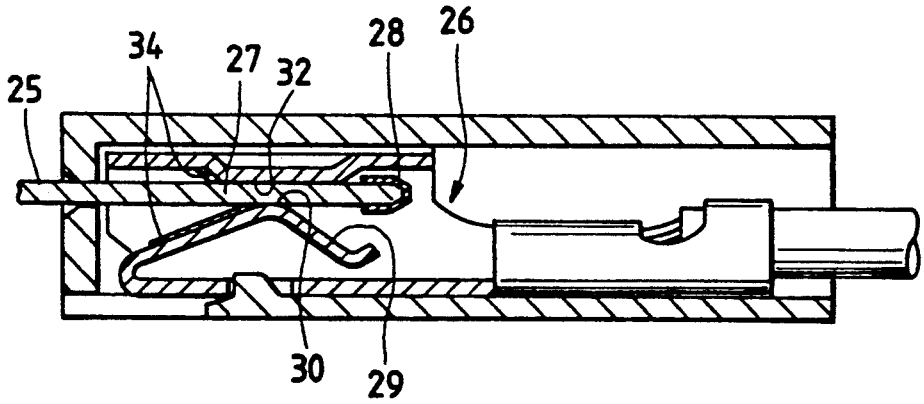
FIG. 6 is a longitudinally sectional view of the terminals shown in FIG. 4, in the state that the terminals are connected to each other.

FIG. 4 shows a pair of a male terminal 25 and a female terminal 26 according to another embodiment of the present invention. The male terminal 25 can be inserted into the lo female terminals 26 by reduced force so as to be connected to the latter. The male and the female terminals 25 and 26 are formed similarly to those 1 and 2 shown in FIGS. 1, 2 and 3. The female terminal 26 is provided in the housing 11' of a connector. The electric contact portion 27 of the male terminal 25, which is a flat plate-like portion, is coated with a non-electroconductive low-friction material 28 at the front end of the portion. The female terminal 26 includes an electric contact part 29, which is an elastic part and has a top 30 as a contact point, and an electric contact projection 32 opposed to the part. The slope 31 of the electric contact part 29, which is located in front of the top 30 of the part, and the slope 33 of the electric contact projection 32, which is located in front of the top of the projection, are coated with a non-electroconductive low-friction material 34. The low-friction materials 28 and 34 are made of Teflon, for example.

To manufacture the male terminal 25, the Teflon 36 is baked on the obverse and reverse sides of the part of a metal plate 35, which corresponds to the low-friction-material-coated part of the electric contact portion 27 of the male terminal, so that the Teflon is secured to the obverse and reverse sides of the metal plate. The metal plate 35 is thereafter punched to make a terminal workpiece 25'. After the punching, the Teflon 36 may be baked on the tab 27' of the terminal workpiece 25' so that the Teflon is secured to the tap. The male terminal 25 can thus be efficiently manufactured. The female terminal 26 can be manufactured in the same manner as the male terminal 25. The process of manufacturing the terminals is discussed in greater detail below.

When the male terminal 25 is to be inserted into the female terminal 26 so as to be connected thereto, the layer of the low-friction material 28 on the tip part of the electric contact portion 27 of the male terminal 25 is slid on that of the other low-friction material 34 on the front slopes 31 and 33 of the electric contact part 29 and electric contact projection 32 of the female terminal 26. For that reason, the electric contact portion 27 of the male terminal 25 can be smoothly and lightly inserted in between the top 30 of the electric contact part 29 of the female terminal 26 and the top of the electric contact projection 32 thereof. A force necessary for the initial stage of the insertion of the male terminal 25 into the female terminal 26 can thus be reduced. As a result of the insertion, the electric contact portion 27 of the male terminal 25 is put in contact with the electric contact part 29 and the electric contact projection 32 of the female terminal 26 so that the terminals are electrically connected to each other.

Figure 7:
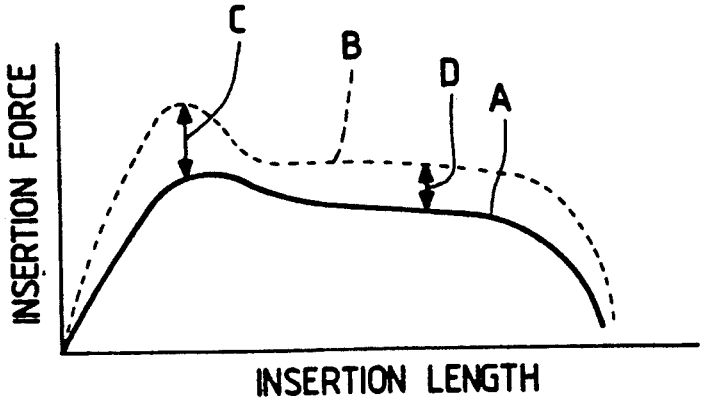
FIG. 7 is a graph to compare the force for the insertion of the latter male terminal into the latter female terminal, with that for the insertion of the conventional male terminal into the conventional female terminal.

FIG. 7 is a graph having an axis of abscissas for the length of the insertion, an axis of the ordinates for the force for the insertion, a full line A indicative of the relationship between the length of the insertion of the male terminal 25 into the female terminal 26 and the force for the insertion, and a dotted line B indicative of the relationship between the length of the insertion of the conventional male terminal 21 into the conventional female terminal 14 and the force for the insertion. It is understood through the examination of the graph that the force for the initial stage of the insertion of the male terminal 25 into the female terminal 26 is lower than that for the initial stage of the insertion of the conventional male terminal 21 into the conventional female terminal 14 as shown at C in FIG. 7, and the resistance to the intermediate stage of the former insertion is smaller that to the FIG. 7. These difference are believed to result from the decrease in the catching property of the male and the female terminals 25 and 26.

The terminals can be manufactured by either (1) applying the low friction material to and baking it on a metal plate prior to stamping the metal plate; or, (2) applying the low friction material to and baking it on interconnected metal terminals after the stamping process.

FIGS. 9(*a*)-9(*d*) illustrate the first process in which a low friction material is applied to and baked on a metal plate before stamping the metal plate. A metal strip 102 which may be plated with tin, silver, white gold or the like is first provided (FIG. 9(*a*)). Then, the low friction material is applied to and baked on the metal plate to form a strip-like low friction portion 104 (FIG. 9(*b*)). The low friction material may be non-conductive or conductive as long as it includes Teflon. Thereafter, the metal strip is punched into interconnected female metal terminals 106 (FIG. 9(*c*) and 9(*d*)). In FIG. 9(*c*), the interconnected female metal terminals have not been subjected to the bending process yet. The female terminals may be separated from each other to form individual terminals immediately after the above-noted process. However, it is preferable that the interconnecting terminals be wound on a roll from the standpoint of transporting the terminals and machining.

FIGS. 10(*a*)-10(*d*) illustrate the second process in which a low friction material is applied to and baked on interconnected female metal terminals after the metal plate has been stamped. A metal strip 110 is first punched into interconnected female metal terminal 112 and then the interconnected female terminals are subjected to the plating process so as to plate the terminals with tin, silver, white gold or the like (FIG. 10(*b*)). Thereafter, a low friction material is applied to and baked on the interconnected female metal terminal to form a low friction portion 114 thereon (FIGS. 10(*c*) and 10(*d*)). These interconnected terminals are then subjected to the bending process and wound on a roll, similar to the first process. Of course, it is understood that the male terminals can be manufactured in the same manner as the female terminals.

Figure 11A:
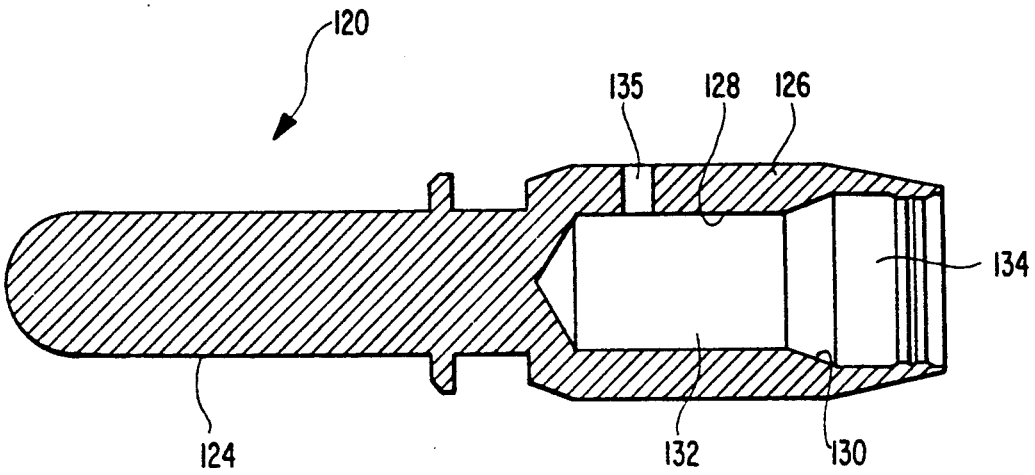
FIGS. 11(*a*)and 11(*b*) are sectional and side views, respectively, of a male terminal according to a further embodiment of the invention.
Figure 11B:
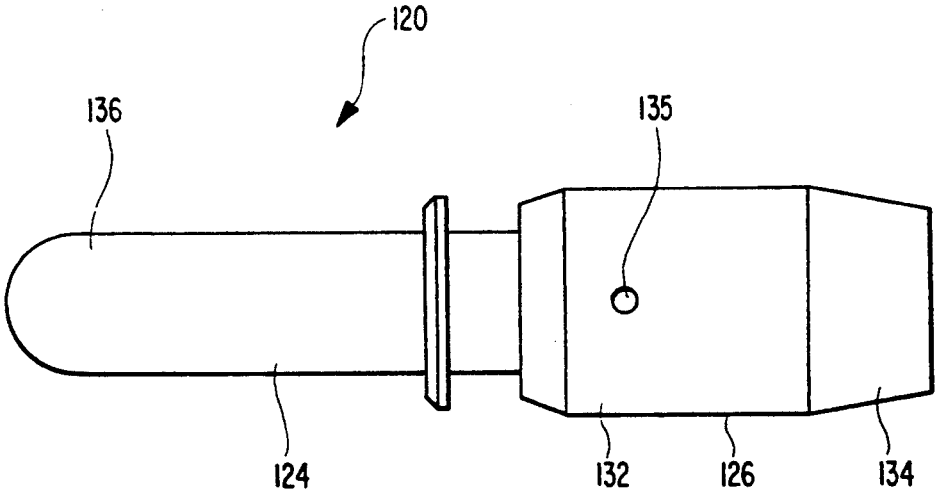

FIGS. 11(*a*)-11(*b*) illustrate male and female terminals according to a further embodiment of the invention. The illustrated male and female connectors are used in cables where a large current flows in an electrically driven automotive vehicle, such as, for example, a connecting portion between a main cable of the vehicle and a charger, and a connecting portion near the large capacity battery, in the electrically driven automotive vehicle. In other words, the male terminal is used at the end of the cable extending from the large capacity battery in the electrically driven vehicle, which end is analogous to a fuel inlet portion communication with a fuel tank in the usual automotive vehicle having an engine. The female connector is used as an end of a current feed device (charger) provided in an electric power supply station which is analogous to a gas station for the usual automotive vehicle. Further, the male and female connectors are used at a portion near the large capacity battery, particularly, between the large capacity battery and a motor corresponding to the engine. At a peripheral portion of an electric circuit in the electrically driven vehicle, the conventional wire harness for the fuel automotive vehicle can be commonly used. However, since a large current flows at the portion between the main cable and the charger, and the portion near the large capacity battery and the portion connecting the large capacity battery to the motor, the male and female connector, illustrated in FIGS. 11(*a*) and (*b*) and 12(*a*) and (*b*), are required.

As illustrated in these figures, each of the male 120 and female 122 metal terminals has a mating side 124 and a cable fixing side 126. The cable fixing side is formed into a hollow cylinder 128 in which a step 130 is provided at the inside thereof. A wire cable (not shown) is pressure-inserted into the cylinder so that a conductor is positioned in the conductor receiving portion 132 (to the left of the step) and an insulating cover around the conductor is position in the cover receiving position 134 (to the right of the step), and then the cable wire is fixed to the connector by caulking an open end of the cylinder. Further, a conductive material may be introduced into the inside of the cylinder through a hole 135 formed in the cylinder to improve electrical conductivity and the fixing property.

The terminals are made of forging brass, and Ni and Ag plating are applied thereon. Further, a low friction material 136 is thereafter applied to and baked on an end portion of the mating side 124 of the male metal terminal. In this embodiment, the low friction material is not applied to the inside of the cylinder of the mating side of the female terminal discussed below.

Figure 12A:
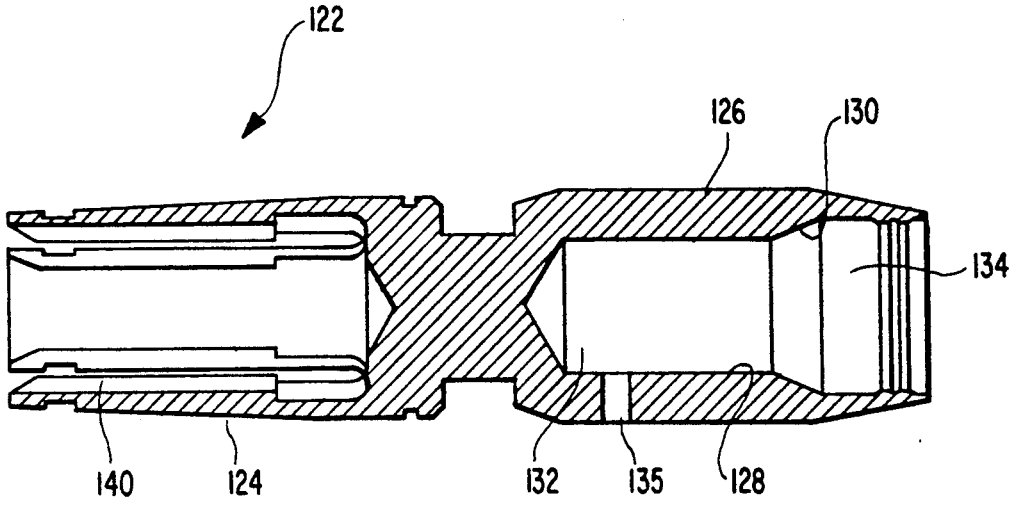
FIGS. 12(*a*) and 12(*b*) are sectional and side views, respectively, of a female terminal in the embodiment of FIGS. 11(*a*) and 11(*b*).
Figure 12B:
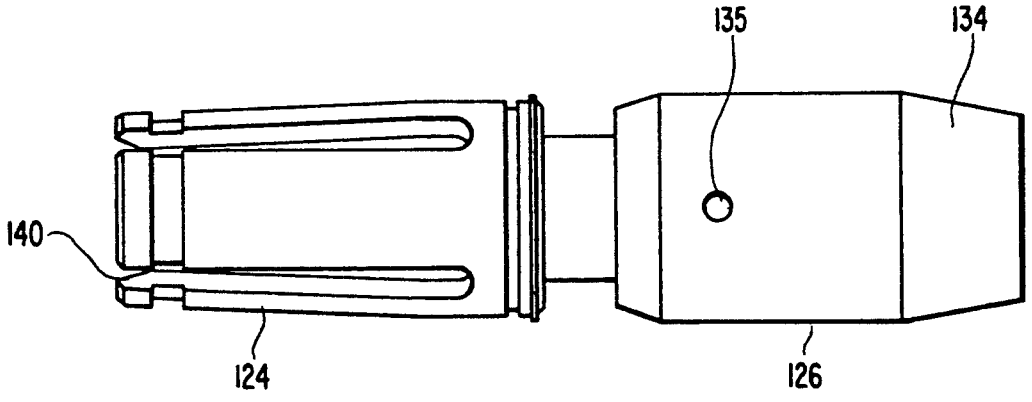

Referring to FIG. 12(*a*) and (*b*), the female metal connector is formed with slits 140 at the mating side 124 thereof for achieving an elastic property, but the terminal itself if very rigid so that a very large insertion force is required to mate the male and female connectors. Therefore, it is more important for the connectors in the electrically driven automobile vehicle to include a low friction material on one of the male and the female connectors. If such low friction material is not applied to the connectors used for the electrically driven vehicle, the plating layer is easily peeled from the connector due to the rigidness thereof, and further the peeled particles of the plating material adversely functions as an abrasive between electrical contact portions of the male and female connectors.

The present invention is not confined to the embodiments described above, but may be embodied or practiced in other various ways without departing from the spirit or essential character of the invention.

What is claimed is:

1. A method of manufacturing one of a male and female terminal having a low friction coating thereon, comprising the following steps:

applying said low friction material to a metal plate in an area corresponding to a portion of said one terminal which first contacts another one of said terminals during interconnection of said terminals;

baking said low friction material onto said area of said metal plate; and punching said metal plate into a shape corresponding to said one terminal.

2. The method of claim 1, wherein said applying step includes the step of providing Teflon in said low friction material.

3. The method of claim 1, wherein said punching step includes punching said metal plate into a plurality of interconnected terminals.

4. The method of claim 3, further comprising the step of rolling said plurality of interconnected terminals on a roll.

5. The method of claim 1, further comprising the step of bending said one terminal into a proper shape.

6. The method of claim 1, further comprising the step of plating said metal plate with a plating.

7. The method of claim 6, further comprising the step of plating said one terminal with a plating after said stamping step.

8. The method of claim 6, wherein said stamping step includes stamping said metal plate into a plurality of said one terminals which are thereafter applied with a low friction material which is baked thereon in said applying and baking steps.

9. A method of manufacturing one of a male and female terminal having a low friction coating thereon, comprising the following steps:

providing a metal plate;

stamping said metal plate into a shape corresponding to said one terminal;

applying a low friction material to a portion of said one terminal which first contacts another one of said terminals during interconnection thereof; and baking said low friction material on said portion.

10. A method of manufacturing male and female terminals for use in high current applications, comprising the following steps:

providing a male terminal having a first cable connecting portion and a first electrical connecting portion;

applying a low friction material to an end portion of said first electrical connection portion and baking said low friction coating thereon;

providing a female terminal having a second cable connection portion and a second electrical contact portion having a tubular shape; and forming a plurality of longitudinal slits in said second electrical contact portion so as to allow elastic outward expansion thereof for receiving said first electrical contact portion of said male terminal.

11. The method of claim 10, further comprising the step of securing respective cables to said first and second cable connection portion.

12. The method of claim 10, further comprising the step of introducing a conductive material into said first and second cable connection portions to improve the electrical contact between said respective cables and said terminals.

13. The method of claim 10, further comprising the step of plating said male and female terminals with a plating.

* * * * *